US009524833B2

(12) United States Patent
Wan

(10) Patent No.: US 9,524,833 B2
(45) Date of Patent: Dec. 20, 2016

(54) ACTION OUTPUT DEVICE FOR MICRO BREAKER

(75) Inventor: Jiasheng Wan, Wuhan (CN)

(73) Assignee: HUBEI SHENGJIA WIRING CO., LTD., Wuhan, Hubei (CN)

( * ) Notice: Subject to any disclaimer, the term of this patent is extended or adjusted under 35 U.S.C. 154(b) by 917 days.

(21) Appl. No.: 13/880,350

(22) PCT Filed: Dec. 17, 2010

(86) PCT No.: PCT/CN2010/002073
§ 371 (c)(1),
(2), (4) Date: Jul. 2, 2013

(87) PCT Pub. No.: WO2012/051743
PCT Pub. Date: Apr. 26, 2012

(65) Prior Publication Data

US 2014/0145521 A1 May 29, 2014

(30) Foreign Application Priority Data

Oct. 18, 2010 (CN) ..... 2010 1 0526492

(51) Int. Cl.

| | |
|---|---|
| ***H01H 3/26*** | (2006.01) |
| ***H01H 9/00*** | (2006.01) |
| ***H01H 71/02*** | (2006.01) |
| ***H01H 71/70*** | (2006.01) |
| ***H01H 71/10*** | (2006.01) |

(52) U.S. Cl.
CPC ..... *H01H 9/00* (2013.01); *H01H 3/26* (2013.01); *H01H 71/0214* (2013.01); *H01H 71/0221* (2013.01); *H01H 71/1009* (2013.01); *H01H 71/70* (2013.01); *H01H 71/1018* (2013.01); *H01H 2003/266* (2013.01); *H01H 2071/0285* (2013.01); *Y10T 307/977* (2015.04)

(58) Field of Classification Search
CPC ..... H01H 9/00
USPC ..... 307/143
See application file for complete search history.

(56) References Cited

U.S. PATENT DOCUMENTS 4,491,709 A * 1/1985 Chabot ..... H01H 3/3021 200/288
4,524,339 A * 6/1985 Chabot ..... H01H 1/5833 335/171
4,649,244 A * 3/1987 Baginski ..... H01H 3/30 200/303

* cited by examiner

*Primary Examiner* — Stephen W Jackson

(57) ABSTRACT

An action output device for a micro breaker, connecting with more than one micro breaker, includes: a shell, the shell comprises: a motor, which is for outputting a torque; an action unit, which is for achieving switching the micro breaker on and off, comprising a rotating part, a poking part, and a linking piece, wherein, the torque outputted by the motor is got by the rotating part; the linking piece is drove to swing by the poking part; the linking piece is connected with an action mechanism of the micro breaker for driving to switch on and off; and a control unit, which controls the motor turning on and off.

14 Claims, 16 Drawing Sheets

ACTION OUTPUT DEVICE FOR MICRO BREAKER

CROSS REFERENCE OF RELATED APPLICATION

This is a U.S. National Stage under 35 U.S.C 371 of the International Application PCT/CN2010/002073, filed Dec. 17, 2010, which claims priority under 35 U.S.C. 119(a-d) to CN 201010526492.x, filed Oct. 18, 2010.

BACKGROUND OF THE PRESENT INVENTION

Field of Invention

The present invention relates to an electric operating mechanism, and more particularly to an action output device for a micro breaker which is capable of combining with at least one micro breaker.

Description of Related Arts

Switch breakers are the essential devices to power sectors for ensuring the electrical safety and switching lines. With the launch of intelligent grids projection, intelligence is an important direction that the micro breakers should take a step forward. It is a good way to realize by the electric operating mechanisms, but present electric operating mechanisms still have following shortcomings that:

1. most of conventional electric operating mechanisms achieve switching on and off to the large-scale switches, which can not meet the actual demand because of the single function and the low intelligent level;
2. present electric operating mechanisms are capable of only control the action of one micro breaker, but not the actions of multiple micro breakers;
3. present electric operating mechanisms achieve controlling the actions and positions mainly by linkage mechanisms, which conventionally require a motor to turn positively and negatively to control switching on and off, leading to the disadvantages that the volumes of the electric operating mechanisms are big and the structure of the linkage institution is complex;
4. when short circuit faults occur, the electric operating mechanisms still achieve switching on according to the instructions, which brings insecurity factors to the users; and
5. present electric operating mechanisms are independent devices which lack of the connections with the micro breakers controlled.

In view of the above defects, the present invention is created after long time of researches and practices.

SUMMARY OF THE PRESENT INVENTION

An object of the present invention is to provide an action output device for a micro breaker to overcome the above technical defects.

Accordingly, in order to accomplish the above objects, the present invention provides an action output device for a micro breaker for connecting with at least one micro breaker, comprising a shell, wherein in the shell is provided with:

a motor, which is for outputting a torque;

an action unit, which is for achieving switching the micro breaker on and off, comprising a rotating part, a poking part, and a linking piece, wherein the torque outputted by the motor is obtained by the rotating part; the linking piece is driven to swing by the poking part; the linking piece is connected with an action mechanism of the micro breaker for driving the micro breaker to switch on and off; and a control unit, for controlling the motor to turn on and off.

Meanwhile, a support plate is provided in the shell, wherein the motor is provided on the support plate.

Preferably, the rotating part is a circular disc, wherein the rotating part is connected with an output axle of the motor.

Preferably, the rotating part is a worm disc meshing with the worm rod provided on the output axle of the motor.

Meanwhile, the poking part is embodied as a poking bar provided on the circular disc.

Preferably, the linking piece comprises: a handle part, pivotally connected with an inner of the shell, wherein a top thereof extends to an external of the shell, a bottom thereof resists against the poking part; and a linking part, sleeving on an upper of the handle part and a handle of the micro breaker.

Preferably, the linking piece comprises: a rotating portion, pivotally connected with the inner of the shell, and having a connecting key placing hole, a bottom thereof resists against the poking part;

a linking part, sleeving on the upper of the handle part and a handle of the micro breaker.

Preferably, the linking part is a connecting rod having a slot, wherein the handle part and the handle of the micro breaker are provided in the slot.

Preferably, the linking part is a connecting rod, wherein the handle part and the handle of the micro breaker have a through-hole, wherein the connecting rod passes through the through-hole.

Preferably, the linking part is a connecting key, wherein the handle of the micro breaker has a connecting key placing hole, wherein both terminals of the connecting key are embedded in the handle of the micro breaker and the connecting key placing hole to realize linkage.

Meanwhile, the control unit comprises:

a power-switching circuit, wherein the power-switching circuit rectifies, filters, and bucks a signal obtained from a phase line, and supports power to electrical components of the control unit;

a position detection circuit, wherein the position detection circuit outputs a first control signal when the micro breaker reaches a target position;

a triggering element, wherein the triggering element obtains the first control signal to trigger the motor to turn on and off.

Preferably, the position detection circuit comprises:

a first limit switch, wherein a first terminal thereof is grounded, and the first limit switch is triggered by a position detection mechanism;

a microprocessor, connected with the first limit switch, and outputting the first control signal when a state of the first limit switch changes; wherein the position detection mechanism comprises:

a first trigger rod, wherein a first terminal thereof is hinged in the shell of the action output device for micro breaker through a hinged axle, wherein a second terminal thereof comprises an extended rod along a direction of the hinged axle, and the second terminal thereof is provided on the first limit switch;

a first arc-shaped groove, provided on the shell of the action output device for the micro breaker, wherein the extended rod stretches out from the shell of the action output device for the micro breaker;

a second arc-shaped groove, provided on the shell of the micro breaker, wherein the extended rod stretches into the first arc-shaped groove and is connected with a linking mechanism of the micro breaker.

Preferably, the position detection circuit comprises:

a first limit switch, wherein a first terminal thereof is grounded, and the first limit switch is triggered by a position detection mechanism; wherein the position detection mechanism comprises:

a first trigger rod, wherein a first terminal thereof is hinged in the shell of the action output device for micro breaker through a hinged axle, wherein a second terminal thereof comprises an extended rod along the direction of the hinged axle, and the second terminal thereof is provided on the first limit switch;

a first arc-shaped groove, provided on the shell of the action output device for the micro breaker, wherein the extended rod stretches out from the shell of the action output device for the micro breaker;

a second arc-shaped groove, provided on the shell of the micro breaker, wherein the extended rod stretches into the first arc-shaped groove and is combined with the a linking mechanism of the micro breaker.

Preferably, the triggering element is a first transistor, wherein a base thereof is connected with a second terminal of the first limit switch, wherein an emitter thereof is grounded, wherein a collector thereof is connected with the motor.

Preferably, the control unit further comprises: a time-delay circuit, wherein the time-delay circuit comprises: a first capacitor, wherein a first terminal thereof is connected with the base of the first transistor, wherein a second terminal thereof is ground; and a discharge resistor, wherein a first terminal thereof is connected with the first transistor, wherein a second terminal thereof is grounded.

Preferably, the control unit further comprises: a short circuit latching circuit, wherein the short circuit latching circuit comprises:

a second limit switch, wherein a first terminal thereof is grounded, and the second limit switch is triggered by a short circuit detection mechanism;

the microprocessor, connected with the second limit switch, for outputting the first control signal when a state of the second limit switch changes; wherein the short circuit detection mechanism comprises:

a short circuit detection rod, hinged in the shell of the action output device for micro breaker, wherein a first terminal thereof stretches out from the shell, wherein the second limit switch is triggered when the short circuit detection rod rotates; and a reset spring, provided at the hinged axle for resetting the hinged axle.

Preferably, the control unit further comprises: a short circuit latching circuit, wherein the short circuit latching circuit comprises:

a second transistor, wherein an emitter thereof is grounded, a collector thereof is connected with the base of the first transistor;

a second limit switch, connected with a base of the second transistor, and triggered by a short circuit detection mechanism, wherein the short circuit detection mechanism comprises: a second linking axle, wherein a first terminal thereof is provided on at least one action mechanism of the micro breaker for short circuit latching, wherein the second linking axle stretches from a side slot of the micro breaker, and is connected into the shell, wherein the second linking axle is provided on the second limit switch.

Preferably, the control unit further comprises: a short circuit indication circuit, for giving an instruction when a short circuit fault occurs at a circuit of the micro breaker, which is a LED connected with the second limit switch.

Preferably, the power-switching circuit comprises:

a diode, for rectifying a current;

a second capacitor, for filtering a wave;

a buck resistor, for bucking a voltage; and a zener, for stabilizing the voltage.

Preferably, the shell comprises:

an inspection switch, provided between the power-switching circuit and the phase line, wherein the power support to the power-switching circuit by the phase line is cut when inspecting.

Preferably, the position detection circuit further comprises:

a photocoupler, wherein an output terminal thereof is connected with a control terminal of the triggering element;

a sampling sub-circuit, obtaining a voltage signal from the phase line, for outputting the voltage signal to the photocoupler after rectifying the current, filtering the wave, and stabilizing the voltage.

Preferably, the position detection circuit further comprises:

an outer control unit, for obtaining an control signal from outside for driving the motor.

Preferably, the outer control unit comprises:

a third transistor, wherein a base thereof obtains the control signal from outside, wherein an emitter is grounded;

a forth transistor, wherein a base thereof is connected with a collector of the third transistor, wherein an emitter is connected with the collector of the second transistor.

Preferably, the control unit further comprises: a microprocessor chip, for controlling the motor.

Preferably, the control unit further comprises: a communication circuit, for interacting a data with external equipments; and a storage circuit, for storing procedures and the corresponding data.

Compared with a conventional technique, the advantages of the present invention comprise that:

1. the actual demand is met because of diversified functions and the high intelligent level;
2. the actions of multiple micro breakers are controlled;
3. the volumes are small and the positions are easy;
4. when short circuit faults occur, the electric operating mechanisms are latched, which has high security; and
5. the precision of controlling is improved through the controlled feedback from the micro breaker.

DETAILED DESCRIPTION OF THE PREFERRED EMBODIMENT

Figure 1A:
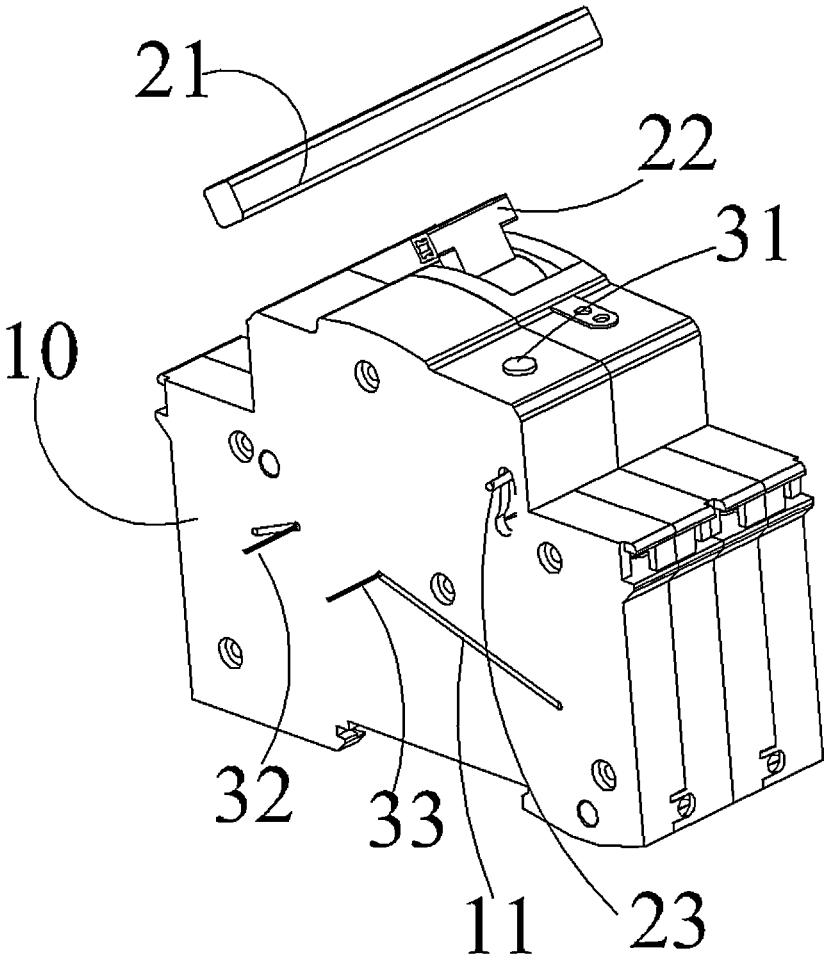
FIG. 1A is a perspective view of an action output device for a micro breaker according to a first preferred embodiment.
Figure 1B:
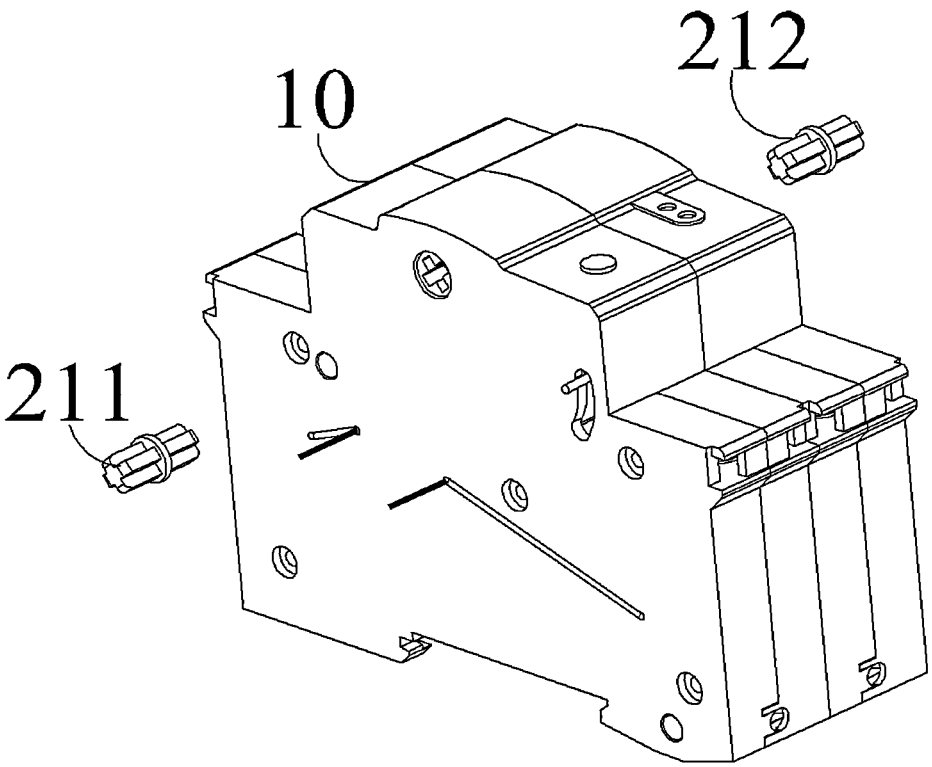
FIG. 1B is the perspective view of the action output device for the micro breaker according to a second preferred embodiment.

Referring to FIG. 1A of the drawings, a perspective view of an action output device for a micro breaker according to a first preferred embodiment, working with other micro breakers, wherein the action output device for the micro breaker connects with at least one micro breaker to achieve the specify action, comprising a shell 10, wherein a handle part 22 stretches out from the shell 10, wherein the handle part 22 and a handle of the micro breaker are connected by a linking part 21, wherein the handle part 22 is driven to swing by a power mechanism and an action unit of the shell for driving the handle of the micro breaker to switch on and off.

A power source of the control unit is supported from the micro breaker comprising at least one connector 32, wherein a needle structure is used for one-one corresponding with chutes provided on the micro breaker, wherein corresponding butt chutes 11 are provided on the shell 10 for adjusting the tightness of combination, wherein the connector 32(33) is capable of obtaining a power, and a control signal, wherein the power signal can be the signal bucked by the micro breaker, and an original voltage of a phase line processed by an inner circuit of the action output device for the micro breaker, wherein an inspection switch 31 is provided on the shell 10, wherein the action output device for micro breaker can not turn on and off when the inspection switch 31 is pressed for inspecting.

Figure 2A:
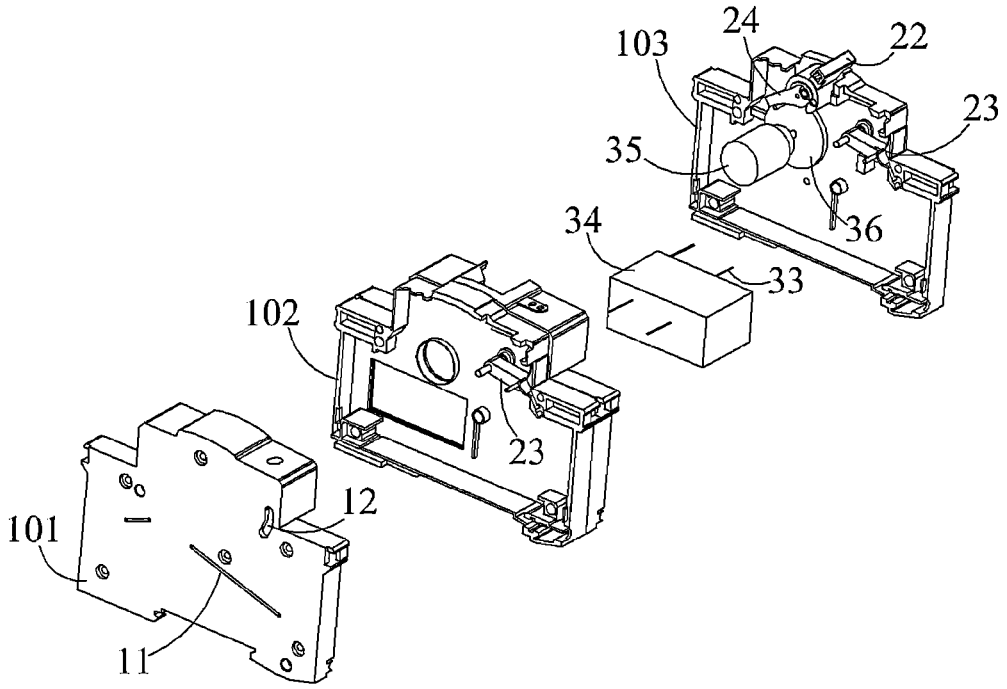
FIG. 2A is an exploded view of the perspective view of the action output device for the micro breaker according to the first preferred embodiment.

Referring to FIG. 2A of the drawings, the perspective view of the action output device for the micro breaker according to a second preferred embodiment, wherein the difference between the above preferred embodiment and present preferred embodiment is that a hole is provided on the shell 10 instead of the handle part, wherein a rotating part is provided in the action unit of the shell, wherein a connecting key placing hole is provided on the rotating part; meanwhile, the linking part is connecting key 211 and 212, wherein a linking mechanism is improved by the micro breaker connected with the action output device for the micro breaker, wherein the connecting key placing hole is provided at the handle of the micro breaker, wherein a first terminal of the connecting key 211 and 212 is combined with the connecting key placing hole provided on the rotating part, a second terminal of the connecting key placing hole is combined with the handle on the micro breaker, wherein an action is sent to the handle of the micro breaker through an action of rotating part by the connecting key 211 and 212 to achieve the specified operation.

The specified operation is that switching on and off, wherein the specified position is that the position when switching on and off.

Referring to FIG. 2A of the drawings, an exploded view of the perspective view of the action output device for the micro breaker according to the first preferred embodiment, wherein the shell of the action output device for micro breaker comprises three parts, respectively are a left side shell 101, a right side shell 103, and a support plate 102 provided at middle, wherein at least one the left side shell 101 and the right side shell 103 comprises a butt chute 11 and an arc-shaped groove 12 used to detect the position; wherein the power mechanism is a motor 35, provided in the support plate 102, wherein an action unit, switching the micro breaker on and off, comprises a rotating part 36, a poking part 24, and a linking piece, wherein, a torque outputted by the motor is got by the rotating part; the rotating part is a circular disc, wherein the rotating part is connected with an output axle of the motor; wherein the poking part 24 is a poking bar provided on the circular disc driving the linking part to swing; wherein the linking part comprises: the handle part 22, wherein an axle thereof is connected with the inner of the shell 10, the top thereof extends to the outer of the shell 10, the bottom thereof resists against the poking part 24; a linking part 21, sleeving on the upper of the handle part 22 and a handle of the micro breaker for driving the micro breaker to switch on and off;

The control unit 34 controls the motor 35 switching on and off, wherein the control unit is provided in the shell 10 in a modular form, which is replaced more convenient, and saves more cost.

Owing to the driving mode of motor 35, wherein the motor 35 rotates 360° to a same direction when working, wherein the poking part 24 drives the handle part 22 to rotate so that the linking part 21 is drove, wherein the handle of the micro breaker swings to achieve the micro breaker switching on and off, wherein the motor should stops rotating through a position detection mechanism when switching on and off to a specified position, wherein the position detection mechanism comprises: a first trigger rod 23, wherein a first terminal thereof is hinged in the shell of the action output device for micro breaker through a hinged axle, wherein a second terminal thereof comprises an extended rod along the direction of the hinged axle, and the second terminal thereof is provided on a first limit switch;

a first arc-shaped groove 12, provided on the shell of the action output device for the micro breaker 10, wherein the extended rod stretches out from the action output device for the micro breaker through the first arc-shaped groove 12;

a second arc-shaped groove 622, provided on the shell of the micro breaker and corresponding to the first arc-shaped groove 12, wherein the extended rod stretches into the first arc-shaped groove and is connected with the a linking mechanism of the micro breaker. When the micro breaker reaches at a specified position, the extended rod is drove by the linking mechanism to swing, and the first trigger rod 23 is drove to swing to press a first limit switch (referring to FIG. 3), wherein the first limit switch is provided at the bottom of the first trigger rod 23. At some states, the action output device for the micro breaker should combines with at least one micro breaker at left and right separately, so the motor 35 stops working once switching on and off, wherein the position detection mechanisms are separately corresponded with the micro breakers combined with the action output device for the micro breaker according to the preferred embodiment.

Further, the support plate 102 of the action output device for the micro breaker comprises the control unit, wherein the support plate stretches out to the connector 33 through the butt chute 11 provided on the side of the shell 10.

Figure 2B:
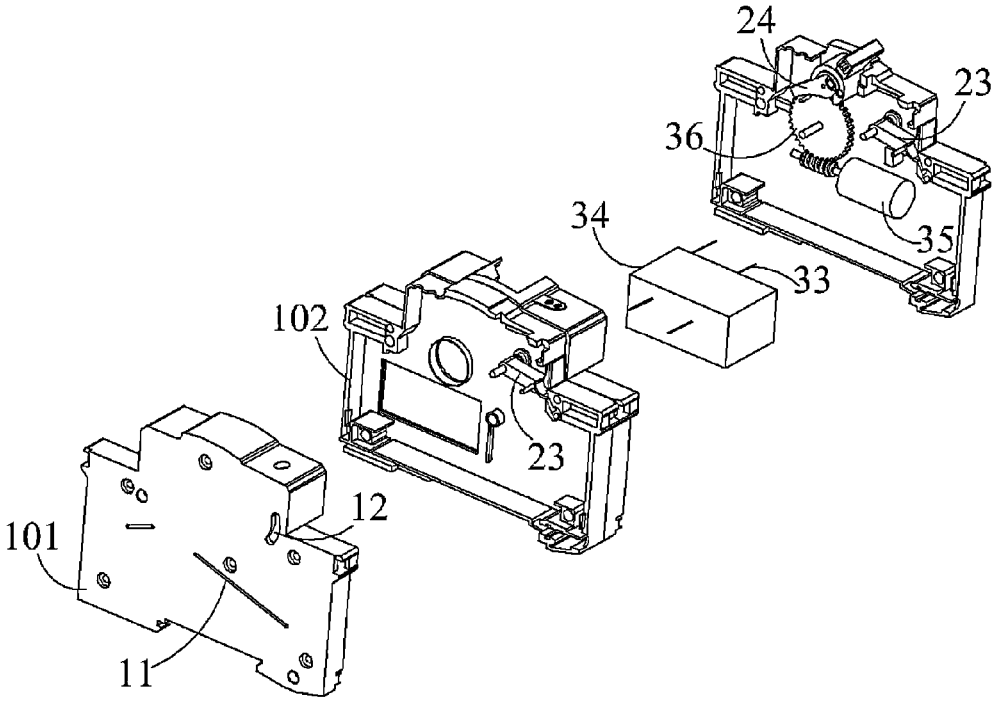
FIG. 2B is another exploded view of the perspective view of the action output device for the micro breaker according to the first preferred embodiment.

Referring to FIG. 2B of the drawings, another exploded view of the perspective view of the action output device for the micro breaker according to the first preferred embodiment, wherein the difference is that the rotating part 36 is a worm disc, wherein the rotating part meshes with the worm rod provided on the output axle of the motor 35. The poking part 24 is provided on the worm rod.

Figure 3:
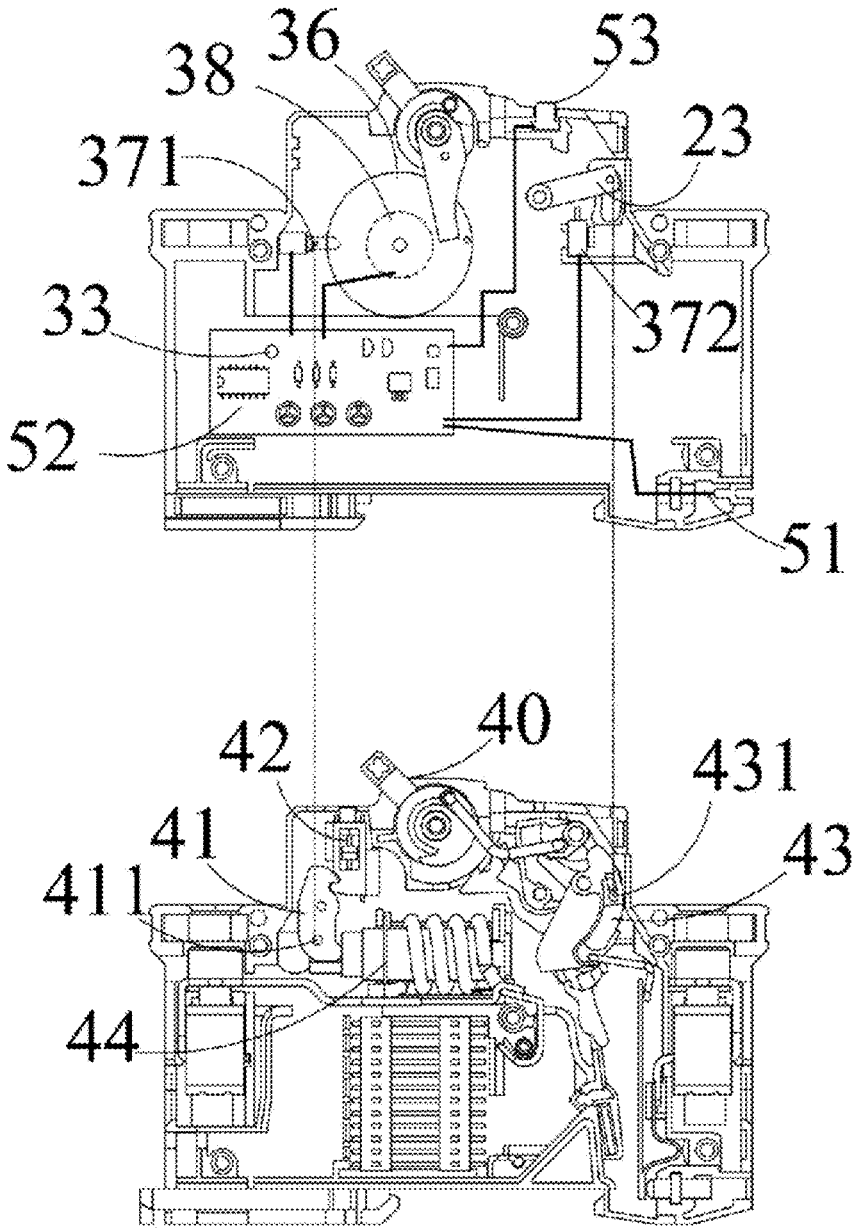
FIG. 3 is a corresponding view of the position detection mechanism and a short circuit detection mechanism in the micro breaker according to the first preferred embodiment.

Referring to FIG. 3 of the drawings, a corresponding view of the position detection mechanism and a short circuit detection mechanism in the micro breaker according to the first preferred embodiment, wherein the action output device for the micro breaker can not switch on automatically when the action output device for the micro breaker coordinates with the micro breaker which has a short circuit self-locking function. The short circuit detection mechanism provided in the shell of the action output device for the micro breaker comprises: a second linking axle 411, wherein a terminal thereof is provided on more than one short circuit self-locking action mechanism, wherein the second linking axle stretches from the side slot of the micro breaker, and is connected into the shell, wherein the second linking axle 411 is provided on the second limit switch 371.

The micro breaker which has a short circuit self-locking function comprises: a rotating arm 41, rotating round an axle in the shell of the micro breaker, wherein a torsional spring is provided on the rotating arm, wherein the rotating arm 41 has an interference terminal, wherein the other terminal thereof leans resists against an armature terminal of an overcurrent release 44 because of the torsional spring effect; a self-locking part 42, wherein the bottom terminal thereof has a groove hooking with the interference terminal; the inner thereof comprises a resetting spring leaning resists against the shell of the micro breaker; when a short circuit occurring, the armature terminal of the overcurrent release 44 acts for driving a linking rod 43 of the linking mechanism of the micro breaker to switching off the micro breaker, wherein the rotating arm 41 rotates because of the torsional spring effect to separate the armature terminal from the groove, wherein the self-locking part 42 moves up under the effect of the resetting spring to stretch out from the through hole of the shell of the micro breaker, wherein the bottom thereof leans resists against the interference terminal of the rotating arm 41 to let the bottom of the rotating arm 41 lean resists against the armature terminal, to let the overcurrent release 44 can not reset, and to let the linking mechanism can not work, further the micro breaker is at the status of self-locking only when the self-locking part 42 is pushed into the shell. To the action output device for the micro breaker, the second linking axle 411 can be provided on the rotating arm 41, wherein the second linking axle 411 presses the second limit switch 371 because of the rotation of the rotating arm 41 to output a control signal to the circuit board of the control unit for stopping the motor 35. A note is that a speed reducer 38 is needed for supporting the torque outputted by the motor 35, wherein the rotating part 36 is connected with the speed reducer 38.

The action output device for the micro breaker comprises an external signal inlet 51, wherein an external signal circuit is provided on the circuit board 52 of the control unit for controlling the action output device for the micro breaker by the external signal.

How the control unit realizes functions will be described in the following content.

Figure 4:
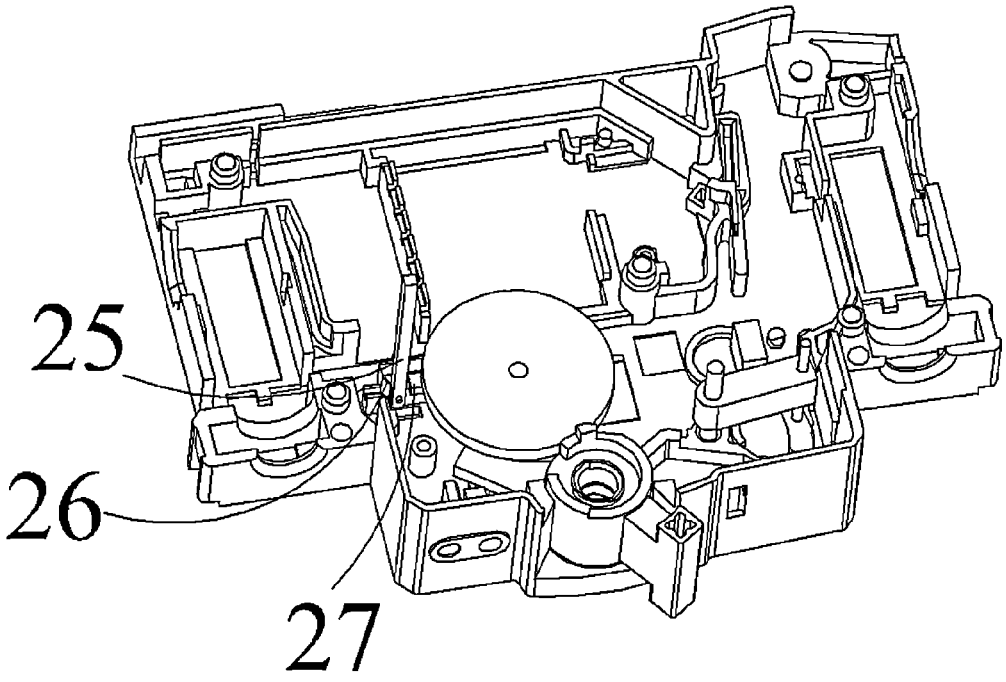
FIG. 4 is a corresponding view of the internal structure of the short circuit detection mechanism according to the first preferred embodiment.
Figure 5:
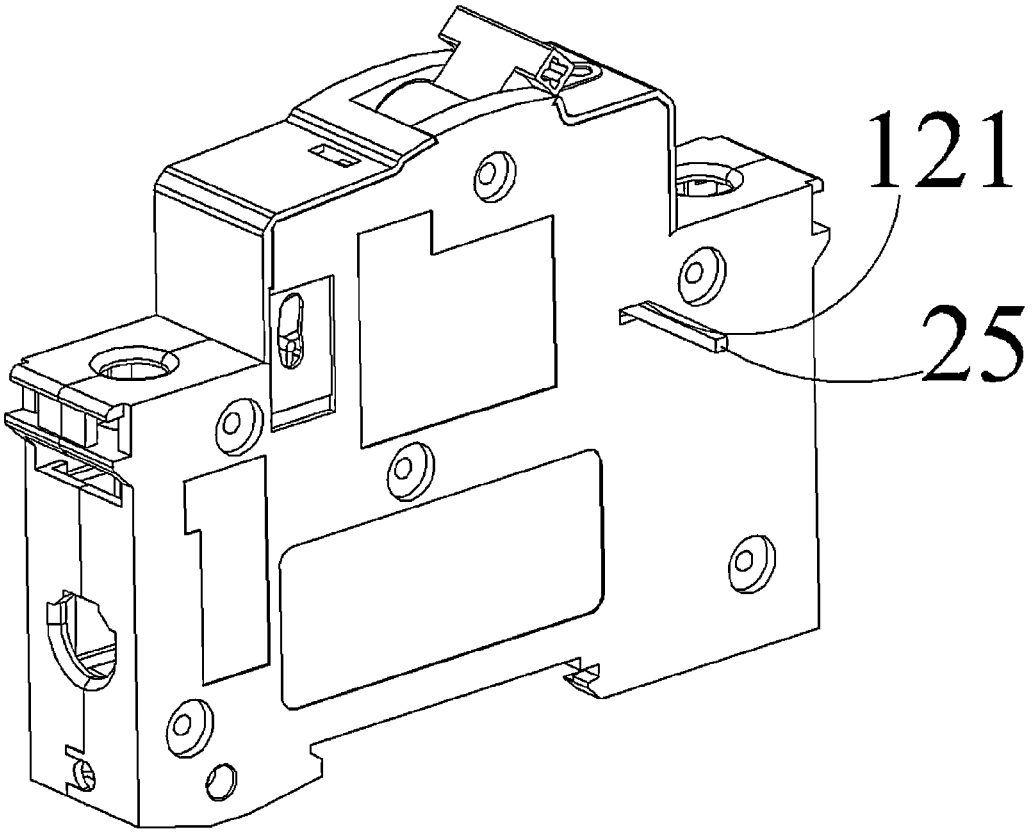
FIG. 5 is a corresponding perspective view of FIG. 4.

Referring to FIG. 4 of the drawings, a corresponding view of the internal structure of the short circuit detection mechanism according to the first preferred embodiment, wherein the short circuit detection mechanism comprises:

a short circuit detection rod 25, hinged in the shell of the action output device for micro breaker, wherein a first terminal thereof stretches out from the shell hole 121 (referring to FIG. 5), wherein the second limit switch 27 is triggered by the short circuit detection rod 25 when the short circuit detection rod rotates; and a reset spring 26, provided at the hinged axle for resetting the hinged axle.

Figure 6A:
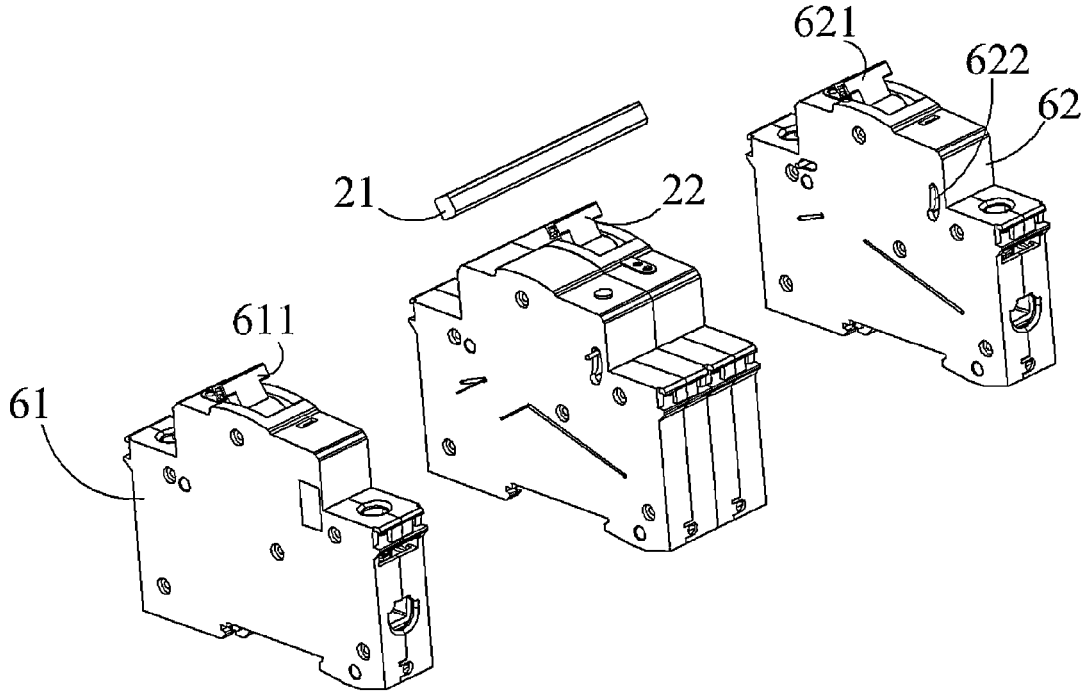
FIG. 6A is a first perspective view of the action output device for the micro breaker at a working condition according to the first preferred embodiment.

Referring to FIG. 6A of the drawings, a first perspective view of the action output device for the micro breaker at a working condition according to the first preferred embodiment; wherein the action output device for the micro breaker connects with the micro breaker 61, 62 provided at two sides, wherein the linking part 21 is a connecting rod which has a slot, wherein the handle 611, 621 of the micro breaker and the top of the handle part 22 are provided through the slot to form joint linkage.

The connector 32, 33 of the action output device for the micro breaker is connected with the corresponding hole provided on the circuit broad of the micro breaker which obtains the signal through the connecting chute provided at the side surface of the micro breaker.

Figure 6B:
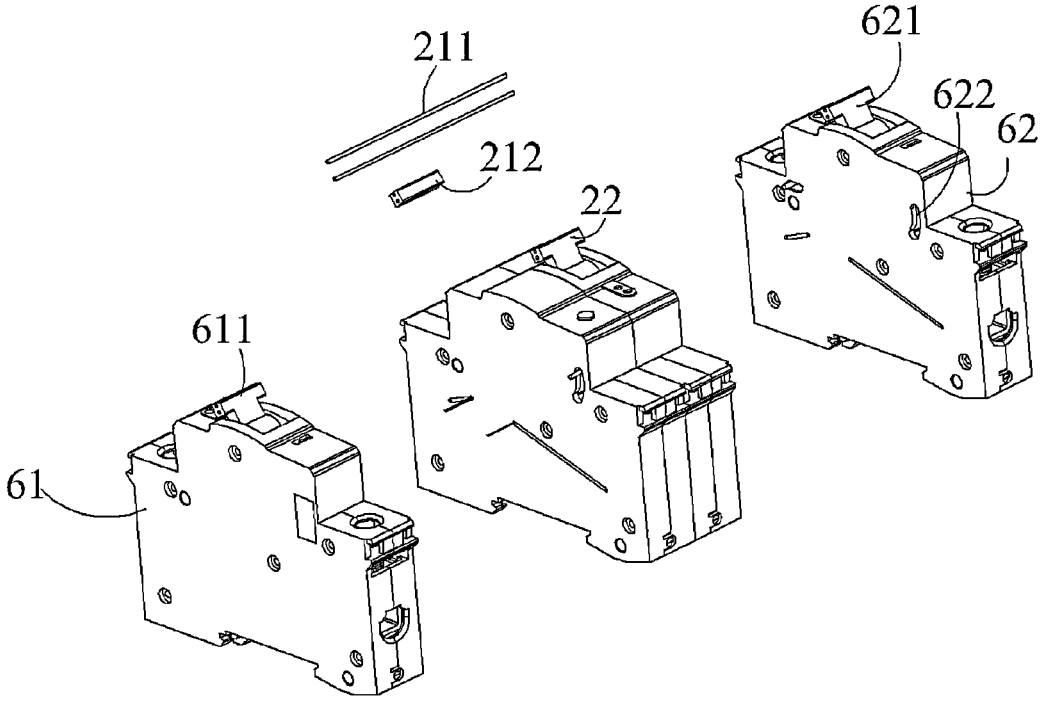
FIG. 6B is a second perspective view of the action output device for the micro breaker at a working condition according to the first preferred embodiment.

Referring to FIG. 6B of the drawings, a second perspective view of the action output device for the micro breaker at a working condition according to the first preferred embodiment; wherein the connecting key 211, the handle 611, 621 of the micro breaker and the top of the handle part of the action output device for the micro breaker comprises through holes, wherein the connecting key 211 passes through the through holes to form joint linkage.

Figure 6C:
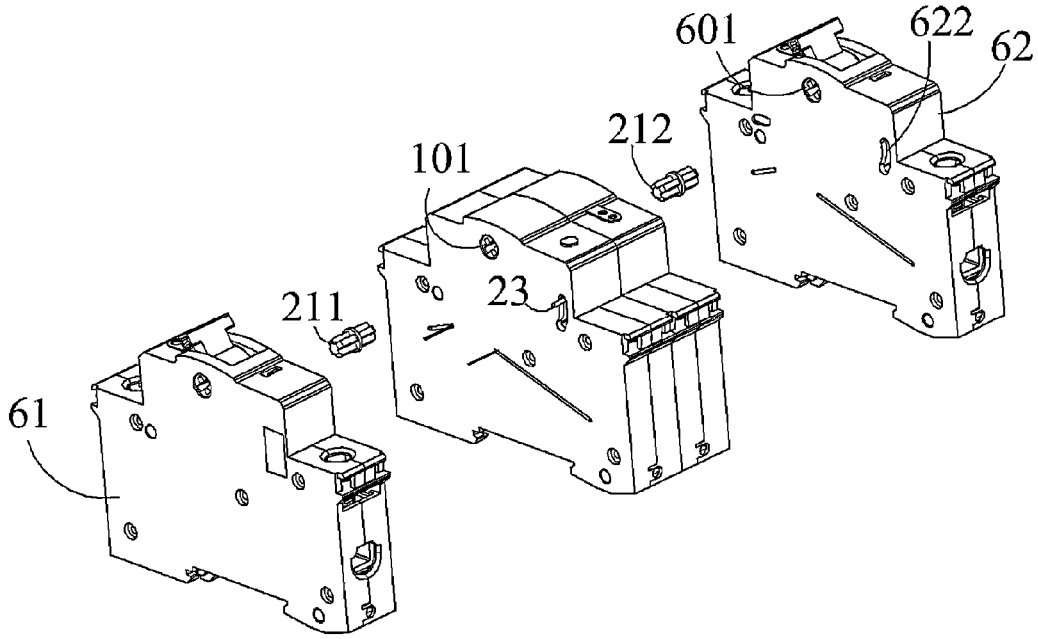
FIG. 6C is a first perspective view of the action output device for the micro breaker at a working condition according to the third preferred embodiment.

Referring to FIG. 6C of the drawings, a first perspective view of the action output device for the micro breaker at a working condition according to the third preferred embodiment; wherein the action output device for the micro breaker has not the handle, wherein when the micro breaker is connected with the action output device for the micro breaker, namely the first terminal of the connecting key 211, 212 is combined with the left side shell 101 provided on the rotating part of the action output device for the micro breaker, wherein the second terminal of the connecting key 211, 212 is combined with the left side shell 101 provided on the handle of the micro breaker, for transferring a rotation to the handle of the micro breaker through the action of the rotating part.

Figure 6D:
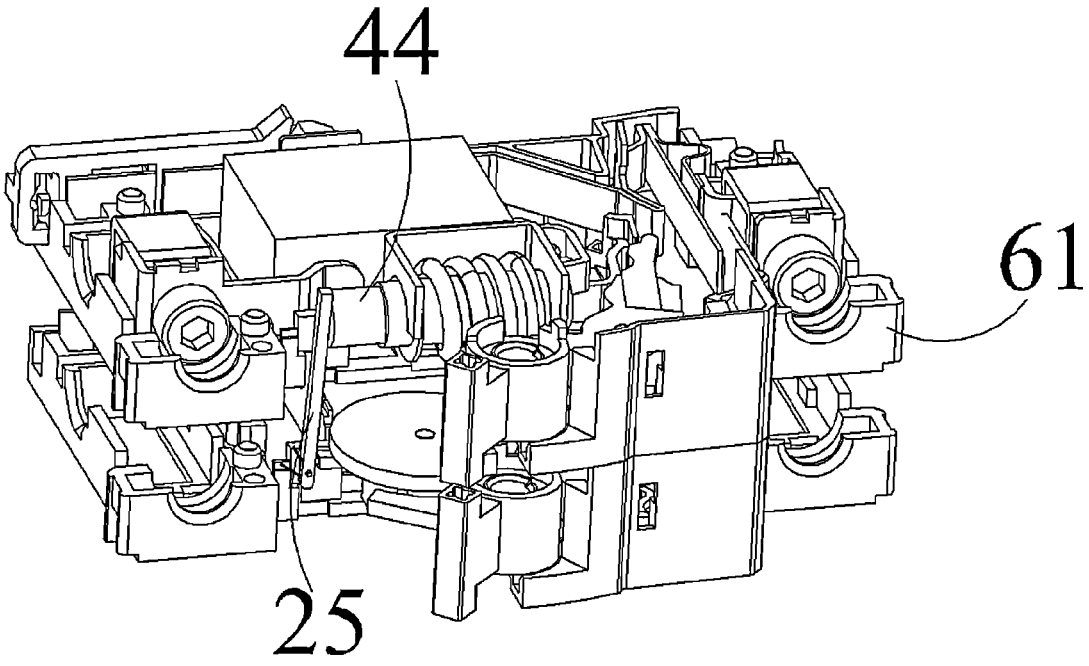
FIG. 6D is an internal structure view of the combination of the structure of the action output device for the micro breaker corresponding with FIG. 4 and the micro breaker.

Referring to FIG. 6D of the drawings, an internal structure view of the combination of the structure of the action output device for the micro breaker corresponding with FIG. 4 and the micro breaker; wherein the micro breaker 61 and the action output device for the micro breaker fit together, wherein the iron core of the overcurrent release 44 leans resists against the short circuit detection rod 25, wherein when a short circuit occurring, the overcurrent release 44 acts for driving the short circuit detection rod 25 to rotate the short circuit detection rod 25 round the axle, wherein a first control signal is outputted by driving the second limit switch 27, wherein when the overcurrent release 44 resets, the second limit switch 27 will not be drove under the effect of the reset spring 26.

Figure 7A:
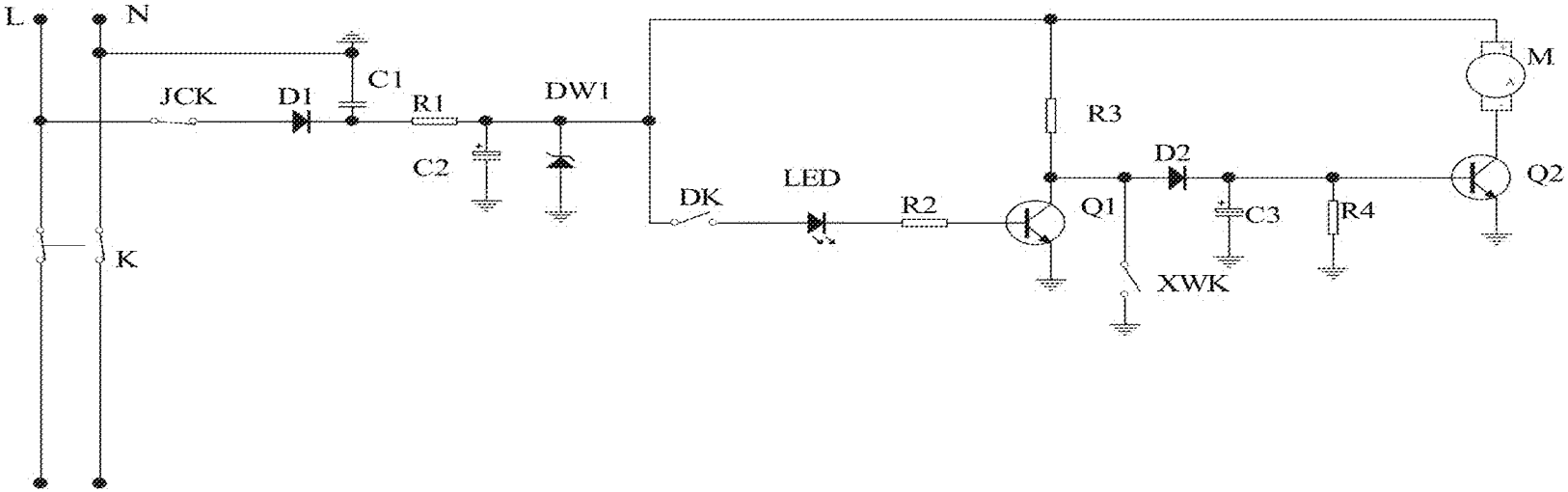
FIG. 7A is a first circuit diagram of the control unit of the action output device for the micro breaker.

Referring to FIG. 7A of the drawings, a first circuit diagram of the control unit of the action output device for the micro breaker; wherein the control unit is for controlling the motor switch on and off, wherein the motor rotates unidirectionally; wherein the control unit comprises:

a power-switching circuit, wherein the power-switching circuit rectifies, filters, and bucks the signal obtained from a phase line L, and supports power to the electrical components of the control unit;

a position detection circuit, wherein the position detection circuit outputs a first control signal when the micro breaker reaches a target position;

a triggering element, wherein the triggering element obtains the first control signal to trigger the motor turning on and off. Wherein, the power-switching circuit comprises: a diode D1, obtaining the signal from a phase line L and rectifying the current (which is directly obtained from the micro breaker by the connector); a second capacitor C1, connected with the diode D1 and the ground terminal for filtering a wave; a buck resistor R1, bucking a voltage; and a zener DW1, stabilizing the voltage.

The position detection circuit comprises:

a first limit switch XWK, wherein a first terminal thereof is grounded, and the first limit switch is triggered by the first trigger rod provided on the position detection mechanism; wherein the triggering element can be a relay or a transistor, wherein a first transistor Q3 is named as an example, wherein a base thereof is connected with the first limit switch XWK, wherein an emitter thereof is grounded, wherein a collector thereof is connected with the motor.

The control unit further comprises: a time-delay circuit, wherein the time-delay circuit comprises: a first capacitor C3, wherein a first terminal thereof is connected with the base of the first transistor Q3, wherein a second terminal thereof is ground; and a discharge resistor R4, wherein a first terminal thereof is connected with the first transistor Q3, wherein a second terminal thereof is grounded, wherein the first limit switch XWK is triggered, in such a matter that the first transistor Q3 still works for a period of time because the first capacitor C3 is at a discharge process, and the micro breaker switches on and off sufficiently.

the shell comprises:

an inspection switch JCK, corresponding with the inspection switch 31 provided on the shell and provided between the power-switching circuit and the phase line L, wherein the power support is cut when inspecting.

the control unit further comprises: a short circuit latching circuit, wherein the short circuit latching circuit comprises:

a second transistor Q2, wherein an emitter thereof is grounded, wherein a collector thereof is connected with the first transistor Q3;

a second limit switch DK, connected with the second transistor Q2, and triggered by a second linkage axle of the short circuit detection mechanism, wherein the control unit further comprises: a short circuit indication circuit, wherein an instruction is given when a short circuit faults occur at a circuit of the micro breaker, wherein the instruction is a LED, connected with the second limit switch DK.

Figure 7B:
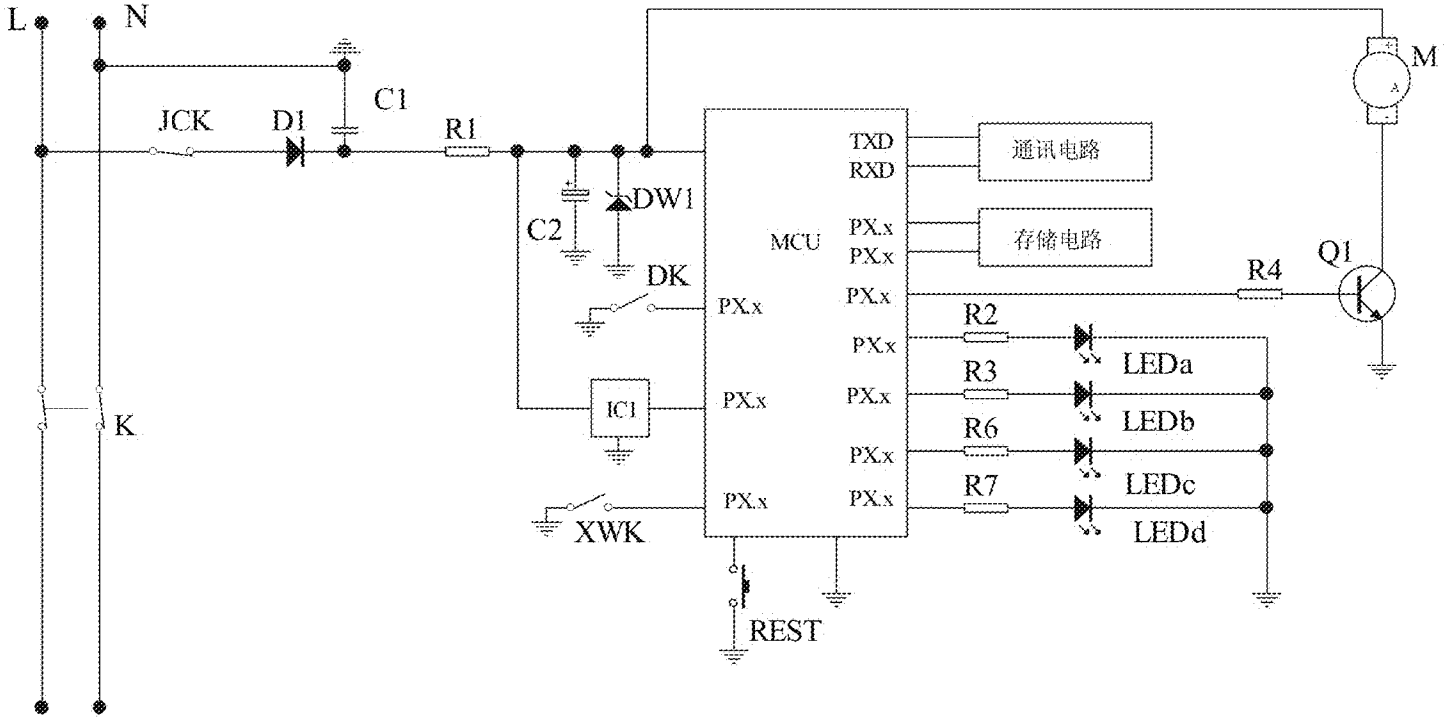
FIG. 7B is a second circuit diagram of the control unit of the action output device for the micro breaker.

Referring to FIG. 7B of the drawings, a second circuit diagram of the control unit of the action output device for the micro breaker; wherein the function of the control unit is achieved by a microprocessor chip MCU which is equivalent to the artificial circuit, which is easy to be realized by the people in the art base on the ideas of the artificial circuit. The signal obtain terminal of the microprocessor chip MCU comprises a temperature collect chip IC1 for collecting temperature parameters at corresponding positions, wherein the microprocessor chip MCU outputs signals when the temperature is too high for controlling the rotation of the motor M to switch off the micro breaker. Indicator lamps LEDa, LEDb, LEDc and LEDd are provided therein, connected with the corresponding signal output terminal of the microprocessor chip MCU for indicating the status of the micro breaker and the action output device for the micro breaker. Because the microprocessor chip MCU is used, a reset bottom REST is provided therein, connected with the microprocessor chip MCU; a communication circuit is provided therein for communicating with the external devices to realize external controlling and interacting and transporting the corresponding data information; and a storage circuit is provided therein for storing control programs and the corresponding status data.

The second limit switch is corresponding with the switch DK, which is corresponding with the short circuit detection structure referring to FIG. 4.

Figure 7C:
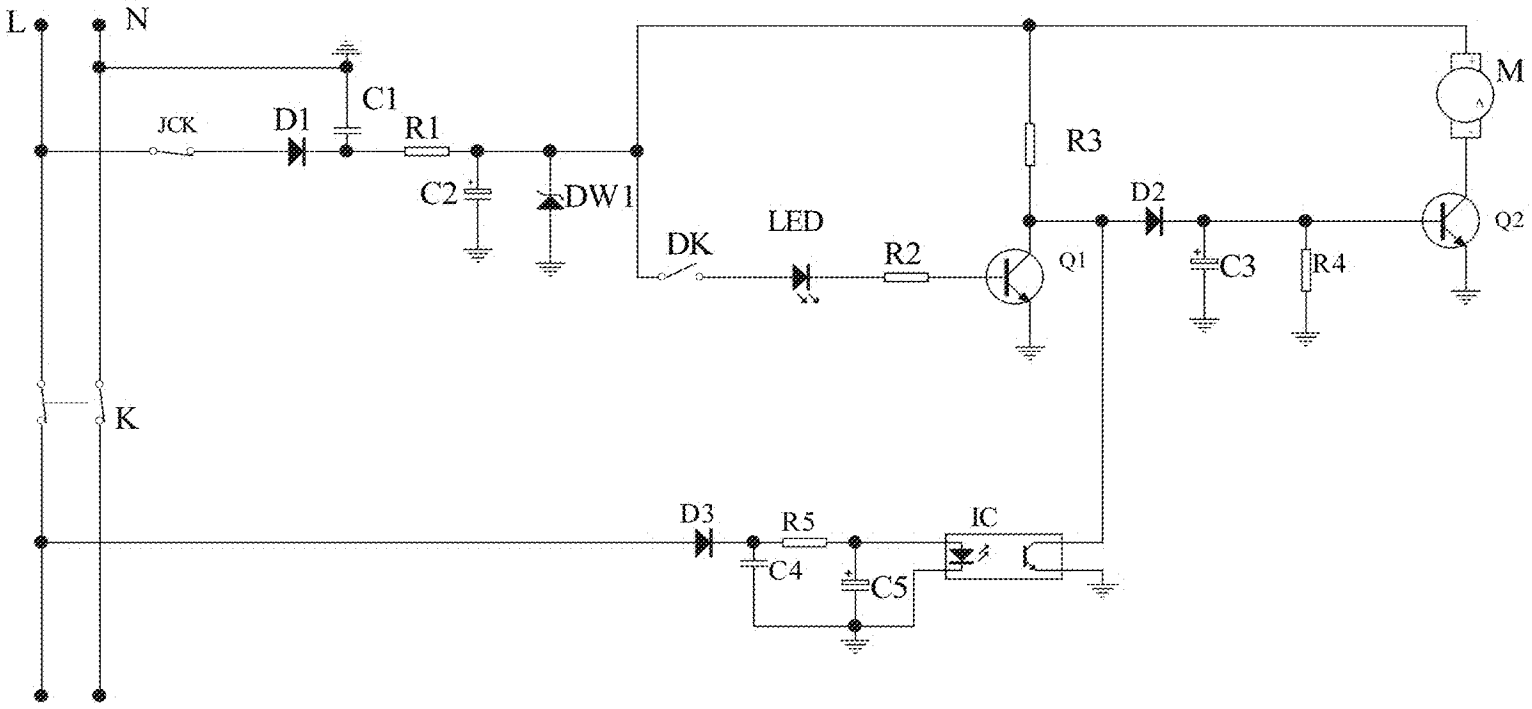
FIG. 7C is a third circuit diagram of the control unit of the action output device for the micro breaker.

Referring to FIG. 7C of the drawings, a third circuit diagram of the control unit of the action output device for the micro breaker; wherein the position detection circuit further comprises:

a photocoupler IC, wherein an output terminal thereof is connected with a control terminal of the first transistor Q3; and a sampling sub-circuit, obtaining a voltage signal from the phase line L, wherein the sampling sub-circuit is connected with the obtain terminal of the photocoupler IC after the voltage signal is outputted to the photocoupler after rectifying the current, filtering the wave, and stabilizing the voltage, wherein the sampling sub-circuit comprises a diode D3, and a capacity C4 used for filtering, wherein the preferred embodiment is for achieving the action of switching on and off the action output device for the micro breaker, wherein the micro breaker is switched off, and the sampling sub-circuit obtains the voltage signal, in such a matter that the photocoupler IC breakovers, and the base of the first transistor Q3 is low potential in such a matter that the motor M stops.

Figure 7D:
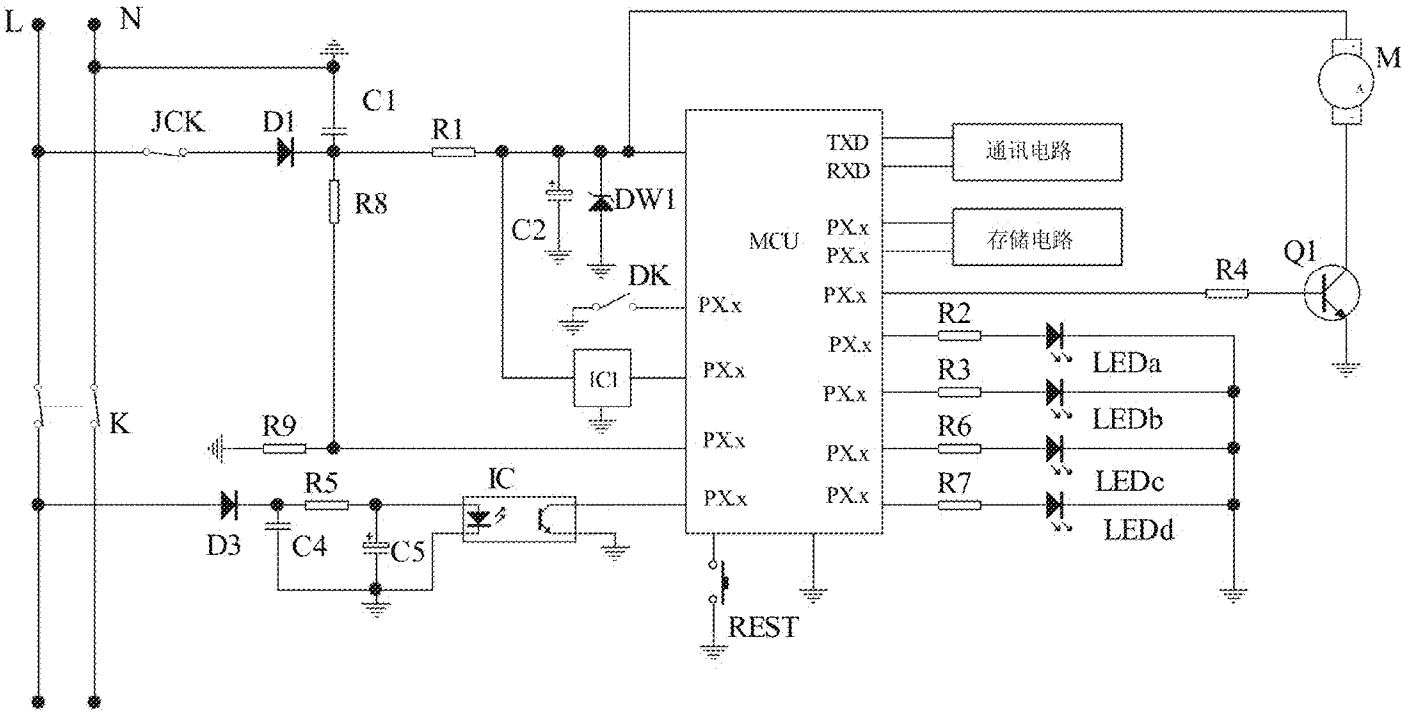
FIG. 7D is a fourth circuit diagram of the control unit of the action output device for the micro breaker.

Referring to FIG. 7D of the drawings, a fourth circuit diagram of the control unit of the action output device for the micro breaker; wherein the position detection circuit further comprises:

a photocoupler IC, wherein an output terminal thereof is connected with a control terminal of the first transistor Q3; and a sampling sub-circuit, obtaining a voltage signal from the phase line L, wherein the sampling sub-circuit is connected with the obtain terminal of the photocoupler IC after the voltage signal is outputted to the photocoupler after rectifying the current, filtering the wave, and stabilizing the voltage, wherein the sampling sub-circuit comprises a diode D3, and a capacity C4 used for filtering, wherein the preferred embodiment is for achieving the action of switching on and off the action output device for the micro breaker, wherein the micro breaker is switched off, and the sampling sub-circuit obtains the voltage signal, in such a matter that the photocoupler IC breakovers, and the base of the first transistor Q3 is low potential in such a matter that the motor M stops.

Figure 7E:
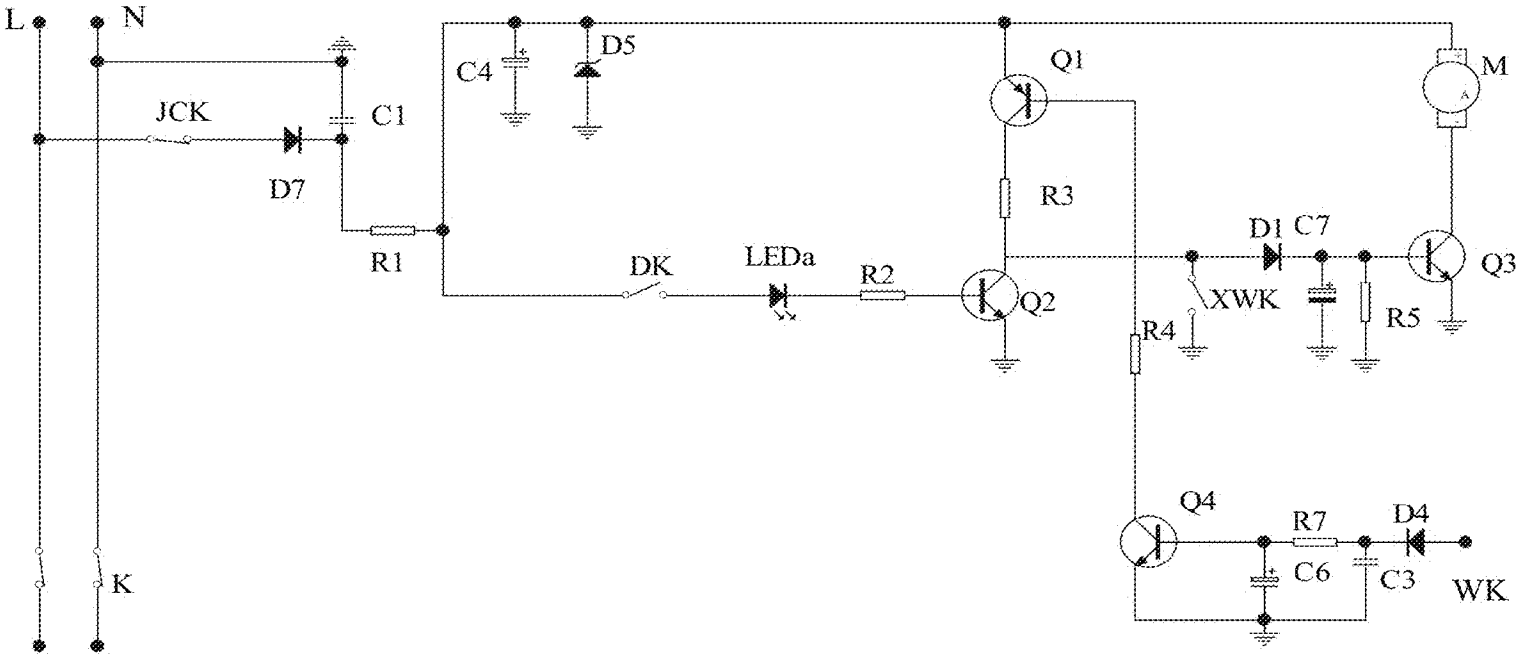
FIG. 7E is a fifth circuit diagram of the control unit of the action output device for the micro breaker.

Referring to FIG. 7E of the drawings, a fifth circuit diagram of the control unit of the action output device for the micro breaker; wherein the position detection circuit further comprises: an outer control unit, obtaining the control signal from outside for driving the motor. The outer control unit comprises: a third transistor Q4, wherein a base thereof obtains the control signal WK from outside, wherein an emitter is grounded; a forth transistor Q1, wherein a base thereof is connected with the third transistor Q4, wherein an emitter is connected with the third transistor Q4. At an initial state, the control signal WK is high potential, and the third transistor Q4 breakovers, so the control to the motor is the same as the first circuit diagram; when the control signal WK is low potential, the third transistor Q4 is in a disconnected state in such a matter that the first transistor Q3 is in the disconnected state, and the motor is in the stopped state.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An action output device for a micro breaker, connecting with at least one micro breaker, comprising:

a shell, wherein said shell comprises:

a motor, for outputting a torque; and an action unit, which is for achieving switching said micro breaker on and off, comprising a rotating part, a poking part, and a linking piece, wherein said torque outputted by said motor is obtained by said rotating part; wherein said linking piece is driven to swing by said poking part; wherein said linking piece is connected with an action mechanism of said micro breaker for driving the micro breaker to switch on and off; and a control unit, which controls said motor turning on and off, wherein:

said rotating part is a circular disc, wherein said rotating part is connected with an output axle of said motor; or said rotating part is a worm disc meshing with said worm rod provided on said output axle of said motor.

2. The action output device for the micro breaker, as recited in claim 1, wherein said poking part is embodied as a poking bar provided on said circular disc.

3. The action output device for the micro breaker, as recited in claim 2, wherein said linking piece comprises: a handle part, pivotally connected with an inner of said shell, wherein a top thereof extends to an external of said shell, abottom thereof resists against said poking part; and a linking part, sleeving on an upper of said handle part and a handle of said micro breaker.

4. The action output device for the micro breaker, as recited in claim 2, wherein said linking piece comprises: a rotating portion, pivotally connected with said inner of said shell, and having a connecting key placing hole, abottom thereof resists against said poking part;

a linking part, sleeving on said upper of said handle part and a handle of said micro breaker.

5. The action output device for the micro breaker, as recited in claim 3, wherein said linking part is a connecting rod having a slot, wherein said handle part and said handle of said micro breaker are provided in said slot; said linking part is a connecting rod, wherein said handle part and said handle of said micro breaker have a through-hole, wherein said connecting rod passes through said through-hole.

6. The action output device for the micro breaker, as recited in claim 4, wherein said linking part is a connecting key, wherein said handle of said micro breaker has a connecting key placing hole, wherein both terminals of said connecting key are embedded in said handle of said micro breaker and said connecting key placing hole to realize linkage.

7. The action output device for the micro breaker, as recited in claim 4, wherein said control unit comprises:

a power-switching circuit, wherein said power-switching circuit rectifies, filters, and bucks a signal obtained from a phase line, and supports power to electrical components of said control unit;

a position detection circuit, wherein said position detection circuit outputs a first control signal when said micro breaker reaches a target position;

a triggering element, wherein said triggering element obtains said first control signal to trigger said motor turning on and off.

8. The action output device for the micro breaker, as recited in claim 7, wherein said position detection circuit comprises:

a first limit switch, wherein a first terminal thereof is grounded, and said first limit switch is triggered by a position detection mechanism;

a microprocessor, connected with said first limit switch, and outputting said first control signal when a state of said first limit switch changes; wherein said position detection mechanism comprises:

a first trigger rod, wherein a first terminal thereof is hinged in said shell of said action output device for micro breaker through a hinged axle, wherein a second terminal thereof comprises an extended rod along a direction of said hinged axle, and said second terminal thereof is provided on said first limit switch;

a first arc-shaped groove, provided on said shell of said action output device for said micro breaker, wherein said extended rod stretches out from said shell of said action output device for said micro breaker;

a second arc-shaped groove, provided on said shell of the micro breaker, wherein said extended rod stretches into said first arc-shaped groove and is connected with a linking mechanism of said the micro breaker.

9. The action output device for the micro breaker, as recited in claim 7, wherein said position detection circuit comprises:

a first limit switch, wherein a first terminal thereof is grounded, and said first limit switch is triggered by a position detection mechanism; wherein said position detection mechanism comprises:

a first trigger rod, wherein a first terminal thereof is hinged in said shell of said action output device for micro breaker through a hinged axle, wherein a second terminal thereof comprises an extended rod along said direction of said hinged axle, and said second terminal thereof is provided on said first limit switch;

a first arc-shaped groove, provided on said shell of said action output device for said micro breaker, wherein said extended rod stretches out from said shell of said action output device for said micro breaker;

a second arc-shaped groove, provided on said shell of the micro breaker, wherein said extended rod stretches into said first arc-shaped groove and is combined with said a linking mechanism of said micro breaker;

said triggering element is a first transistor, wherein a base thereof is connected with a second terminal of said first limit switch, wherein an emitter thereof is grounded, wherein a collector thereof is connected with said motor.

10. The action output device for the micro breaker, as recited in claim 9, wherein said control unit further comprises: a time-delay circuit, wherein said time-delay circuit comprises: a first capacitor, wherein a first terminal thereof is connected with said base of said first transistor, wherein a second terminal thereof is ground; and a discharge resistor, wherein a first terminal thereof is connected with said first transistor, wherein a second terminal thereof is grounded.

11. The action output device for the micro breaker, as recited in claim 10, wherein said control unit further comprises: a short circuit latching circuit, wherein said short circuit latching circuit comprises:

a second limit switch, wherein a first terminal thereof is grounded, and said second limit switch is triggered by a short circuit detection mechanism;

said microprocessor, connected with said second limit switch, for outputting said first control signal when a state of said second limit switch changes; wherein said short circuit detection mechanism comprises:

a short circuit detection rod, hinged in said shell of said action output device for micro breaker, wherein a first terminal thereof stretches out from said shell, wherein said second limit switch is triggered when said short circuit detection rod rotates; and a reset spring, provided at said hinged axle for resetting said hinged axle.

12. The action output device for the micro breaker, as recited in claim 9, wherein said control unit further comprises: a short circuit latching circuit, wherein said short circuit latching circuit comprises:

a second transistor, wherein an emitter thereof is grounded, wherein a collector thereof is connected with said first transistor;

a second limit switch, connected with a base of said second transistor, and triggered by a short circuit detection mechanism, wherein said short circuit detection mechanism comprises: a second linking axle, wherein a first terminal thereof is provided on at least one action mechanism of said micro breaker for short circuit latching, wherein said second linking axle stretches from a side slot of said micro breaker, and is connected into said shell, wherein said second linking axle is provided on said second limit switch.

13. The action output device for the micro breaker, as recited in claim 12, wherein said control unit further comprises: an inspection switch, provided between said power-switching circuit and said phase line, wherein said power support is cut when inspecting.

14. The action output device for the micro breaker, as recited in claim 7, wherein said position detection circuit further comprises:

a photocoupler, wherein an output terminal thereof is connected with a control terminal of said triggering element;

a sampling sub-circuit, obtaining a voltage signal from said phase line, for outputting said voltage signal to said photocoupler after rectifying said current, filtering said wave, and stabilizing said voltage.

* * * * *